US010138438B2

(12) United States Patent
Houten

(10) Patent No.: US 10,138,438 B2
(45) **Date of Patent: *Nov. 27, 2018**

(54) LOW SULFUR MARINE DISTILLATE FUEL TRUNK PISTON ENGINE OIL COMPOSITION

(71) Applicant: Chevron Oronite Technology B.V., San Ramon, CA (US)

(72) Inventor: Wilhelmus Petrus Antonie Van Houten, Prinsenbeek (NL)

(73) Assignee: Chevron Oronite Technology B.V., Rotterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/046,752

(22) Filed: Feb. 18, 2016

(65) Prior Publication Data

US 2016/0237370 A1 Aug. 18, 2016

Related U.S. Application Data

(60) Provisional application No. 62/117,819, filed on Feb. 18, 2015.

(51) Int. Cl.

| | |
|---|---|
| ***C10M 141/08*** | (2006.01) |
| ***C10M 129/54*** | (2006.01) |
| ***C10M 135/08*** | (2006.01) |
| ***C10M 163/00*** | (2006.01) |
| ***C10M 169/04*** | (2006.01) |

(52) U.S. Cl.

CPC ..... *C10M 141/08* (2013.01); *C10M 129/54* (2013.01); *C10M 135/08* (2013.01); *C10M 163/00* (2013.01); *C10M 169/045* (2013.01); *C10M 2203/1006* (2013.01); *C10M 2207/262* (2013.01); *C10M 2215/28* (2013.01); *C10M 2219/088* (2013.01); *C10M 2223/045* (2013.01); *C10N 2210/02* (2013.01); *C10N 2220/022* (2013.01); *C10N 2230/02* (2013.01); *C10N 2230/08* (2013.01); *C10N 2230/10* (2013.01); *C10N 2230/52* (2013.01); *C10N 2240/102* (2013.01)

(58) Field of Classification Search

CPC ..... C10M 141/08; C10M 129/54; C10M 135/08; C10M 163/00; C10M 169/045; C10M 2203/1006; C10M 2207/262; C10M 2215/28; C10M 2219/088; C10M 2223/045; C10N 2210/02; C10N 2230/02; C10N 2230/08; C10N 2230/10; C10N 2230/52; C10N 2240/102; C10N 2220/022

See application file for complete search history.

(56) References Cited

U.S. PATENT DOCUMENTS

| | | | | |
|---|---|---|---|---|
| 2,680,096 | A | 6/1954 | Walker et al. | |
| 3,036,003 | A | 5/1962 | Verdol et al. | |
| 3,172,892 | A | 3/1965 | Le Seur et al. | |
| 3,178,368 | A | 4/1965 | Hanneman et al. | |
| 3,219,666 | A | 11/1965 | Norman et al. | |
| 3,272,746 | A | 9/1966 | Le Seur et al. | |
| 3,275,554 | A | 9/1966 | Wagenaar et al. | |
| 3,329,658 | A | 7/1967 | Fields et al. | |
| 3,438,757 | A | 4/1969 | Honnen et al. | |
| 3,449,250 | A | 6/1969 | Fields et al. | |
| 3,454,555 | A | 7/1969 | van der Voort et al. | |
| 3,565,804 | A | 2/1971 | Honnen et al. | |
| 3,586,629 | A | 6/1971 | Otto et al. | |
| 3,591,598 | A | 7/1971 | Traise et al. | |
| 3,666,730 | A | 5/1972 | Coleman | |
| 3,801,507 | A | 4/1974 | Hendrickson et al. | |
| 3,980,569 | A | 9/1976 | Pindar et al. | |
| 4,234,435 | A | 11/1980 | Meinhardt et al. | |
| 4,251,379 | A | 2/1981 | Le Coent et al. | |
| 4,744,921 | A | 5/1988 | Liston | |
| 5,024,773 | A | 6/1991 | Liston | |
| 5,318,710 | A | 6/1994 | Campbell | |
| 5,320,762 | A | 6/1994 | Campbell | |
| 5,320,763 | A | 6/1994 | Campbell | |
| 5,529,705 | A * | 6/1996 | Small, Jr. | C10M 159/22 508/287 |
| 5,716,912 | A | 2/1998 | Harrison et al. | |
| 6,165,235 | A | 12/2000 | Kolp et al. | |
| 6,372,696 | B1 | 4/2002 | Tipton | |
| 6,440,905 | B1 | 8/2002 | Epps et al. | |
| 2007/0027043 | A1 | 2/2007 | Le Coent | |
| 2015/0087567 | A1 * | 3/2015 | Ushioda | C10M 163/00 508/198 |

OTHER PUBLICATIONS

Leslie R. Rudnick, "Lubricant Additives: Chemistry and Applications," New York, Marcel Dekker, Chapter 1, pp. 1-28 (2003).

* cited by examiner

*Primary Examiner* — Cephia D Toomer

(74) *Attorney, Agent, or Firm* — Ryan, Mason & Lewis, LLP

(57) ABSTRACT

The present invention generally relates to a trunk piston engine oil composition designed for use with low sulfur distillate fuel where the lubricating oil has a low base number but is capable of providing oxidative stability, viscosity increase control, and improved detergency performance. The present invention also generally relates to a method for lubricating a trunk piston engine and a method for operating a trunk piston engine using said trunk piston engine oil composition.

20 Claims, No Drawings

LOW SULFUR MARINE DISTILLATE FUEL TRUNK PISTON ENGINE OIL COMPOSITION

This patent application claims priority to U.S. Provisional patent application 62/117,819 which was filed on Feb. 18, 2015.

FIELD OF THE INVENTION

The present invention generally relates to a trunk piston engine oil composition designed for use with low sulfur distillate fuel where the lubricating oil has a low base number but is capable of providing oxidative stability, viscosity increase control, and improved detergency performance.

BACKGROUND OF THE INVENTION

Trunk piston engines are generally medium speed (300-1000 rpm), 4-stroke engines, in which a single lubricating oil is employed for lubrication of all areas of the engine, as opposed to the crosshead engines in which the crosshead allows use of separate lubricants in the cylinder and in the crankcase. A trunk piston engine oil (TPEO) therefore has unique requirements for fuel compatibility, oxidative stability, viscosity increase control, and detergency.

Traditionally fuel oils used for the operation of trunk piston engines have ranged from heavy marine residual fuel to low sulfur distillate fuel. Recently, driven by health and environmental concerns, there has been increasing probability of future regulations mandating the use of low sulfur fuel for the operation of trunk piston engines. The use of low sulfur residual fuel requires that it is feasible for refineries to lower the sulfur level in residual fuel at a reasonable cost and effort. It is unknown whether there will be sufficient low-sulfur residual fuel oil available in the future, or whether low sulfur distillate fuel and gas oils will be used to a wider extent. It is therefore desirable to provide a trunk piston engine oil composition designed for use with low sulfur distillate fuel where the lubricating oil has a low base number but is capable of providing oxidative stability, viscosity increase control, and improved detergency performance.

Additives, especially metal-containing alkaline detergent additives, have been used for many years in the formulation of TPEOs to neutralize acid combustion gases, maintain engine cleanliness, ensure compatibility of the lubricant with residual fuel oil, and control viscosity increase. However, it remains unclear if TPEOs formulated with additive technology developed for use with residual fuel oils will in fact be optimum for the low sulfur distillate marine fuels of the future due to differences in the characteristics of the fuels and differences in the environment of trunk piston engines due to the varying sources of fuels.

Key performance parameters for operating trunk piston engines with either heavy marine residual fuels or low sulfur distillate fuels include: deposit control of the piston cooling gallery (also known as the undercrown), deposit control of the piston ring pack (this includes the rings, lands and grooves), viscosity increase control, and sludge control. For marine residual fuels operation, these performance parameters are almost exclusively driven by asphaltenes contamination from the marine residual fuels.

For distillate fuel operation, however, where the fuel contains no significant asphaltenes present in the fuels, these performance parameters are driven by combustion byproducts from the distillate fuel. Therefore, the requirements for engines operated using low sulfur distillate fuels versus marine residual fuels are very different. As a result, this does not allow for performance read-across of a formulation from distillate fuel operation to marine residual fuels operation or vice versa. A formulation that is specifically designed to offer optimum performance for marine residual fuels operation would not be expected to automatically provide acceptable performance for distillate fuel operation. For example, down-treating traditional 70 TBN Marine Cylinder Lubricant formulations optimized for high sulfur marine residual fuels operation to 40 TBN Marine Cylinder Lubricant formulations have been shown to have unacceptable performance for low sulfur Marine Cylinder Lubricant operation. Further, down-treating traditional 70 TBN Marine Cylinder Lubricant formulations optimized for high sulfur marine residual fuels operation to even lower TBN Marine Cylinder Lubricant formulations have also been found to have unacceptable performance for distillate fuel operation.

SUMMARY OF THE INVENTION

In accordance with one embodiment of the present invention, there is provided a low sulfur marine distillate fuel trunk piston diesel engine lubricating oil composition comprising:

(a) a major amount of a Group I base oil;

(b) a detergent composition comprising:

(i) a medium overbased detergent comprising an overbased salt of a linear alkyl-substituted hydroxybenzoic acid, wherein at least 90 mole % of the alkyl groups are $C_{20}$ or greater, and wherein the TBN of the medium overbased detergent on an actives basis is from about 100 to 300 mg KOH/g;

(ii) a high overbased detergent comprising an overbased salt of a linear alkyl-substituted hydroxybenzoic acid, wherein at least 90 mole % of the alkyl groups are $C_{20}$ or greater, and wherein the TBN of the high overbased detergent on an actives basis is greater than about 300 mg KOH/g; and (iii) a non-overbased sulfurized alkylphenate detergent which is substantially free of polyol promoter oxidation products; and which is prepared by the process comprising: contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur, wherein the non-overbased sulfurized alkylphenate detergent is present at less than 3.5 wt %;

wherein the ratio of weight % medium overbased detergent (i) to weight % high overbased detergent (ii) is from about 0.1:1 to 10:1;

wherein the TBN of the composition is less than 30 mg KOH/g; and wherein the composition does not contain an overbased detergent comprising a salt of an alkyl-substituted hydroxybenzoic acid having at least 50 mole % of alkyl groups that are $C_{14}$-$C_{18}$.

In accordance with another embodiment of the present invention, there is provided a method for operating a trunk piston engine comprising:

(a) fueling the engine with a low sulfur marine distillate fuel, and (b) lubricating the engine with a lubricating oil composition comprising:

(1) a major amount of a Group I base oil;

(2) a detergent composition comprising:

(i) a medium overbased detergent comprising an overbased salt of a linear alkyl-substituted hydroxybenzoic acid, wherein at least 90 mole % of the alkyl groups are $C_{20}$ or greater, and wherein the TBN of the medium overbased detergent on an actives basis is from about 100 to 300 mg KOH/g;

(ii) a high overbased detergent comprising an overbased salt of a linear alkyl-substituted hydroxybenzoic acid, wherein at least 90 mole % of the alkyl groups are $C_{20}$ or greater, and wherein the TBN of the high overbased detergent on an actives basis is greater than about 300 mg KOH/g; and (iii) a non-overbased sulfurized alkylphenate detergent which is substantially free of polyol promoter oxidation products; and which is prepared by the process comprising: contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur, wherein the non-overbased sulfurized alkylphenate detergent is present at less than 3.5 wt %;

wherein the ratio of weight % medium overbased detergent (i) to weight % high overbased detergent (ii) is from about 0.1:1 to 10:1;

wherein the TBN of the composition is less than 30 mg KOH/g; and wherein the composition does not contain an overbased detergent comprising a salt of an alkyl-substituted hydroxybenzoic acid having at least 50 mole % of alkyl groups that are $C_{14}$-$C_{18}$.

It has now been surprisingly discovered that marine trunk piston engine lubricating oil compositions designed for the lubrication of trunk piston engines operating on low sulfur distillate fuel, comprising the above detergent composition leads to optimum performance in the areas of oxidative stability, viscosity increase control, and high temperature detergency.

DEFINITIONS

The following terms will be used throughout the specification and will have the following meanings unless otherwise indicated. Any term, abbreviation or shorthand not defined is understood to have the ordinary meaning used by a skilled artisan contemporaneous with the submission of this application.

"A major amount" of an oil of lubricating viscosity refers to a concentration of the oil within the lubricating oil composition of at least about 40 wt. %. In some embodiments, "a major amount" of an oil of lubricating viscosity refers to a concentration of the oil within the lubricating oil composition of at least about 50 wt. %, at least about 60 wt. %, at least about 70 wt. %, at least about 80 wt. %, or at least about 90 wt. %.

A "residual fuel" refers to a material combustible in large marine engines which has a carbon residue, as defined in International Organization for Standardization (ISO) 10370) of at least 2.5 wt. % (e.g., at least 5 wt. %, or at least 8 wt. %) (relative to the total weight of the fuel), a viscosity at 50° C. of greater than 14.0 cSt, such as the marine residual fuels defined in the International Organization for Standardization specification ISO 8217:2005, "Petroleum products—Fuels (class F)—Specifications of marine fuels," the contents of which are incorporated herein in their entirety. Residual Fuels are primarily the non-boiling fractions of crude oil distillation. Depending on the pressures and temperatures in refinery distillation processes, and the types of crude oils, slightly more or less gas oil that could be boiled off is left in the non-boiling fraction, creating different grades of Residual Fuels.

A "marine residual fuel" refers to a fuel meeting the specification of a marine residual fuel as set forth in the ISO 8217:2010 international standard. A "low sulfur marine fuel" refers to a fuel meeting the specification of a marine residual fuel as set forth in the ISO 8217:2010 specification that, in addition, has about 1.5 wt. % or less, or even about 0.5% wt. % or less, of sulfur, relative to the total weight of the fuel, wherein the fuel is the residual product of a distillation process.

Distillate fuel is composed of petroleum fractions of crude oil that are separated in a refinery by a boiling or "distillation" process. A "marine distillate fuel" refers to a fuel meeting the specification of a marine distillate fuel as set forth in the ISO 8217:2010 international standard. A "low sulfur marine distillate fuel" refers to a fuel meeting the specification of a marine distillate fuel set forth in the ISO 8217:2010 international standard that, in addition, has about 0.1 wt. % or less, 0.05 wt. % or less, or even about 0.005 wt. % or less, of sulfur, relative to the total weight of the fuel, wherein the fuel is a distillation cut of a distillation process.

A "high sulfur fuel" refers to a fuel having greater than 1.5 wt. % of sulfur, relative to the total weight of the fuel.

A "conventional salicylate-based detergent" refers to an alkyl-substituted hydroxyaromatic detergent wherein at least 50% of the alkyl groups by volume are $C_{14}$-$C_{18}$.

The term "bright stock", as used by persons skilled in the art, refers to base oils that are direct products of de-asphalted petroleum vacuum residuum or derived from de-asphalted petroleum vacuum residuum after further processing such as solvent extraction and/or dewaxing. For the purposes of this invention, it also refers to deasphalted distillate cuts of a vacuum residuum process. Bright stocks generally have a kinematic viscosity at 100.degree. C. of from 28 to 36 mm.sup.2/s. One example of such a bright stock is ESSO™ Core 2500 Base Oil.

The term "Group II metal" or "alkaline earth metal" means calcium, barium, magnesium, and strontium.

The term "calcium base" refers to a calcium hydroxide, calcium oxide, calcium alkoxide and the like and mixtures thereof.

The term "lime" refers to calcium hydroxide also known as slaked lime or hydrated lime.

The term "alkylphenol" refers to a phenol group having one or more alkyl substituents at least one of which has a sufficient number of carbon atoms to impart oil solubility to the resulting phenate additive.

The term "non-overbased", when used to describe a detergent, refers to a detergent which has not been further treated with an overbasing agent after the neutralization step is performed in the manufacture of the detergent. Examples of suitable overbasing agents are carbon dioxide, a source of boron (i.e. boric acid), sulfur dioxide, hydrogen sulfide and ammonia. The most preferred overbasing agent is carbon dioxide, therefore, treatment of detergents with an overbasing agent can also be referred to as "carbonation". In addition, non-overbased detergents can also be considered as "non-carbonated". Although non-overbased detergents do not undergo a carbonation step, there may be excess based present in the detergent in the form of dispersed calcium hydroxide and the detergent may therefore display higher levels of basicity, for example if the basic salt is added in stoichiometric excess to that required for complete neutralization of the detergent itself.

The term "Total Base Number" or "TBN" or "base number" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both.

The term "on an actives basis" indicates that only the active component(s) of a particular additive are considered when determining the concentration or amount of that particular additive within the overall marine trunk piston engine lubricating oil composition. Diluent oil in the additive is excluded.

In the following description, all numbers disclosed herein are approximate values, regardless whether the word "about" or "approximate" is used in connection therewith. They may vary by 1 percent, 2 percent, 5 percent, or, sometimes, 10 to 20 percent.

The lubricating oil compositions, trunk piston engine lubricating oil compositions, and trunk piston engine oils (TPEO) described herein (collectively "lubricating oil compositions") can be used for lubricating any trunk piston engine, marine trunk piston engine, or compression-ignited (diesel) marine engine, such as a 4-stroke trunk piston engine or a 4-stroke diesel marine engine.

DETAILED DESCRIPTION OF THE INVENTION

The detergent composition employed in the present invention is a mixture of a medium and high overbased alkali or alkaline earth metal salts of an alkyl-substituted hydroxybenzoic acid, wherein at least about 90 mole % of the alkyl groups are $C_{20}$ or greater, and a non-overbased sulfurized alkylphenate detergent which is substantially free of polyol promoter oxidation products.

In one embodiment, at least about 90 mole %, at least about 95 mole %, or at least about 99 mole % of the alkyl groups contained within the medium or high overbased alkali or alkaline earth metal salt of an alkyl-substituted hydroxybenzoic acid detergent are a $C_{20}$ or higher (such as $C_{20}$ to $C_{40}$, $C_{20}$ to $C_{35}$, $C_{20}$ to $C_{30}$, $C_{20}$ to $C_{28}$, or $C_{20}$ to $C_{25}$). In another embodiment, the medium or high overbased alkali or alkaline earth metal salt of an alkyl-substituted hydroxybenzoic acid is derived from an alkyl-substituted hydroxybenzoic acid in which the alkyl groups are the residue of straight chain normal alpha-olefins containing at least 90 mole % $C_{20}$ or higher straight chain normal alpha-olefins. In another embodiment, the medium or high overbased alkali or alkaline earth metal salt of an alkyl-substituted hydroxybenzoic acid is derived from an alkyl-substituted hydroxybenzoic acid in which the alkyl groups are the residue of straight chain normal alpha-olefins containing at least 90 mole % $C_{20}$ to $C_{28}$ normal alpha-olefins.

The resulting medium or high overbased alkali or alkaline earth metal salt of an alkyl-substituted hydroxybenzoic acid will be a mixture of ortho and para isomers. In one embodiment, the product will contain about 1 to 99 wt. % ortho isomer and 99 to 1 wt. % para isomer. In another embodiment, the product will contain about 5 to 70 wt. % ortho and 95 to 30 wt. % para isomer.

The medium or high overbased alkali or alkaline earth metal alkyl-substituted hydroxybenzoic acid detergent of the present invention, having a mixture of $C_{20}$ to $C_{28}$ alky groups, can be prepared from linear alpha olefin cuts, such as those marketed by Chevron Phillips Chemical Company under the names Normal Alpha Olefin $C_{26}$ to $C_{28}$ or Normal Alpha Olefin $C_{20}$ to $C_{24}$ having from about 20 to 28 carbon atoms.

Generally, an overbased alkali or alkaline earth metal salt of an alkyl-substituted hydroxybenzoic acid is one in which the TBN of the alkali or alkaline earth metal salts of an alkyl-substituted hydroxybenzoic acid has been increased by a process such as the addition of a base source (e.g., lime) and an acidic overbasing compound (e.g., carbon dioxide).

In one embodiment, the medium overbased alkali or alkaline earth metal salts of an alkyl-substituted hydroxybenzoic acid is a medium overbased detergent having a TBN from about 100 to about 300 mg KOH/g on an actives basis. In one embodiment, the TBN of the medium overbased detergent is from 150 to 300 mg KOH/g. In another embodiment, the TBN of the medium overbased detergent is from 100 to 260 mg KOH/g. In another embodiment, the TBN of the medium overbased detergent is from about 200 to about 300 mg KOH/g. In another embodiment, the TBN of the medium overbased detergent is from 150 to 260 mg KOH/g.

In one embodiment, the high overbased alkali or alkaline earth metal salts of an alkyl-substituted hydroxybenzoic acid is a high overbased detergent having a TBN greater than 300 mg KOH/g on an actives basis. In one embodiment, the TBN of the high overbased detergent is from 325 to 700 mg KOH/g. In another embodiment, the TBN of the high overbased detergent is from 350 to 650 mg KOH/g. In another embodiment, the TBN of the high overbased detergent is from 350 to 600 mg KOH/g. In another embodiment, the TBN of the high overbased detergent is from 400 to 600 mg KOH/g on an actives basis.

Generally, the medium and high overbased detergents are each present in the lubricating oil composition in an amount ranging from about 0.01 wt. % to about 10 wt. %, based on the total weight of the lubricating oil composition. In one embodiment, the medium overbased detergent is present at from 1 to 8 wt. %. In one embodiment, the medium overbased detergent is present at from 1 to 6 wt. %. In one embodiment, the medium overbased detergent is present at from 1 to 5 wt. %. In one embodiment, the medium overbased detergent is present at from 1 to 4 wt. %.

In one embodiment, the high overbased detergent is present at from 1 to 8 wt. %. In one embodiment, the high overbased detergent is present at from 1 to 6 wt. %. In one embodiment, the high overbased detergent is present at from 1 to 5 wt. %. In one embodiment, the high overbased detergent is present at from 1 to 4 wt. %.

In one embodiment, the ratio of the medium overbased detergent to the high overbased detergent is 0.1:1 to 10:1 based on the weight % of the medium overbased detergent to the weight % of the high overbased detergent in the lubricating oil composition. In other embodiments the ratio is 1.0:1 to 3.0:1, 0.5:1 to 5:1, 1.15:1 to 2.0:1 and 0.1:1 to 5:1.

In one embodiment, the medium overbased detergent can be prepared from alkylphenols, for example, according to the method described in Example 3 of U.S. Patent Application Publication No. 2007/0027043, the contents of which are incorporated herein by reference in their entirety.

In one embodiment, the high overbased detergent can be prepared from alkylphenols, for example, according to the method described in Example 1 of U.S. Patent Application Publication No. 2007/0027043, the contents of which are incorporated herein by reference in their entirety.

In another embodiment, the marine diesel engine lubricating oil compositions of the present invention also contain as component (iii) from about 0.1 wt. % to about 10.0 wt. % based on the total weight of the marine diesel engine lubricating oil composition, of a non-overbased sulfurized alkylphenate detergent which is substantially free of polyol promoter oxidation products. In other embodiments, the non-overbased sulfurized alkylphenate detergent is present from about 0.1 wt. % to about 8.0 wt. %, from about 0.1 wt. % to about 6.0 wt. %, from about 0.1 wt. % to about 5.0 wt. %, from about 0.1 wt. % to about 4.5 wt. %, from about 0.1 to about 4.0 wt. %, from about 0.1 wt. % to about 3.5 wt. %, from about 0.1 wt. % to about 3.0 wt. %, from about 0.1 wt. % to about 2.0 wt. %, and from about 0.1 wt. % to about 1.0 wt. %. In other embodiments, the non-overbased sulfurized alkylphenate detergent is present at from less than 10 wt. %, less than 8 wt. %, less than 7 wt. %, less than 6 wt. %, less than 5 wt. %, less than 4.5 wt. %, less than 4.0 wt. %, less than 3.5 wt. %, less than 3.0 wt. %, less than 2.5 wt. %, less than 2.0 wt. %, less than 1.5 wt. %, and less than 1.5 wt. %.

The Non-overbased Sulfurized Alkylphenate Detergent

In general, the non-overbased sulfurized alkylphenate detergent which is substantially free of polyol promoter oxidation products can be prepared without the use of a polyol or lower alkanol sulfurization promoter (i.e. alkylene glycol, such as ethylene glycol). The sulfurization-neutralization step is done in the presence of a lower carboxylic acid catalyst. Polyol promoters in the presence of significant amounts of sulfur can become oxidized, while the sulfur is reduced to hydrogen sulfide. Because a polyol promoter is not used during the sulfurization-neutralization step, the resulting non-overbased sulfurized alkylphenate detergent is free of polyol oxalates or other deleterious byproducts of a polyol promoter.

The non-overbased sulfurized alkylphenate detergent which is substantially free of polyol promoter oxidation products is obtained by the process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur (see, e.g., U.S. Pat. No. 5,529,705, the contents of which are incorporated by reference herein).

The process for preparing the non-overbased sulfurized, alkaline earth metal alkylphenate detergent can be conveniently conducted by contacting the desired alkylphenol with sulfur in the presence of a lower alkanoic acid and calcium base under reactive conditions. If desired, the alkylphenol can be contacted with sulfur in an inert compatible liquid hydrocarbon diluent. The reaction can be conducted under an inert gas, such as nitrogen. In theory the neutralization can be conducted as a separate step prior to sulfurization, but it is generally more convenient to conduct the sulfurization and the neutralization together in a single process step. Also, in place of the lower alkanoic acid, salts of the alkanoic acids or mixtures of the acids and salts could also be used. Where salts or mixtures of salts and acids are used, the salt is preferably an alkaline earth metal salt such as a calcium salt. In general, the acids are preferred and the process will be described below with respect to the use of lower alkanoic acid; however, it should be appreciated that the teachings are also applicable to the use of salts and mixtures of salts in place of all or a portion of the acids.

The combined neutralization and sulfurization reaction is typically conducted at temperatures in the range of about from about 115° C. to about 250° C. or from about 135° C. to about 230° C., depending on the particular alkanoic acid used. Where formic acid is used, a temperature in the range of about 150° C. to about 200° C. can be used. Where acetic acid or propionic acid are used, higher reaction temperatures may be advantageously employed, for example, at temperatures in the range of about 180° C. to about 250° C. or from about 200° C. to about 235° C.

If desired, mixtures of two or all three of the lower alkanoic acids also can be used. For example, mixtures containing about from about 5 to about 25 wt. % formic acid and about from about 75 to about 95 wt. % acetic acid can be used where low or medium overbased products are desired. Based on one mole of alkylphenol typically, from about 0.8 to about 3.5, preferably about 1.2 to about 2 moles of sulfur and about 0.025 to about 2, preferably about 0.1 to about 0.8 moles of lower alkanoic acid are used. Typically, about 0.3 to about 1 mole preferably, about 0.5 to about 0.8 mole of calcium base are employed per mole of alkylphenol.

In addition, an amount of calcium base sufficient to neutralize the lower alkanoic acid is also used. Thus, from about 0.31 to about 2 moles of calcium base are used per mole of alkylphenol including the base required to neutralize the lower alkanoic acid. If preferred, lower alkanoic acid to alkylphenol and calcium base to alkylphenol ratios are used, the total calcium base to alkylphenol ratio range will be about from about 0.55 to about 1.2 moles of calcium base per mole of alkylphenol. As one skilled in the art will readily appreciate, this additional calcium base will not be required where salts of alkanoic acids are used in place of the acids.

The reaction may be carried out in a compatible liquid diluent, such as a low viscosity mineral or synthetic oil. The reaction is conducted for a sufficient length of time to ensure complete reaction of the sulfur, e.g., where high TBN products are desired because the synthesis of such products generally requires using carbon dioxide together with a polyol promoter. Accordingly, any unreacted sulfur remaining in the reaction mixture will catalyze the formation of deleterious oxidation products of the polyol promoter during the overbasing step.

Where the neutralization is conducted as a separate step, both the neutralization and the subsequent sulfurization are conducted under the same conditions as set forth above. In either case, it is desirable to remove water generated by the neutralization of the alkylphenol. This is conventional and generally is accomplished by continuous distillation during the neutralization. Conveniently, a high molecular weight alkanol having 8 to 16 carbon atoms may be added to the neutralization-sulfurization step and/or the overbasing step as a solvent and also to assist in the removal of water by forming a water-azeotrope which may then be distilled off.

Optionally specialized sulfurization catalysts such as those described in U.S. Pat. No. 4,744,921, the disclosure of which is hereby incorporated in its entirety, can be employed in the neutralization-sulfurization reaction together with the lower alkanoic acid. However, any benefit afforded by the sulfurization catalyst, for example, reduced reaction time, is offset by the increase in costs incurred by the catalyst and/or the presence of undesired residues in the case of halide catalysts or alkali metal sulfides; especially, as excellent reaction rates can be obtained by merely using acetic and/or propionic acid and increasing reaction temperatures.

Although the non-overbased sulfurized alkylphenate detergent does not undergo an overbasing, or carbonation, step after the neutralization-sulfurization reaction, the non-overbased sulfurized alkylphenate detergent displays higher levels of basicity due to excess base excess based present in the detergent in the form of dispersed calcium hydroxide. The TBN of the non-overbased sulfurized alkylphenate detergent made by this process is from about 100 to about 180 mg KOH/gm based on the additive concentrate.

In one embodiment, the TBN of the non-overbased sulfurized alkylphenate detergent is from about 180 to about 250 on an actives basis. In one embodiment, the TBN of the non-overbased sulfurized alkylphenate detergent is from about 190 to about 240, about 190 to about 230, about 180 to about 220, and about 190 to 220.

In one embodiment, the diluent oil in the non-overbased sulfurized alkylphenate detergent is from about 5 to about 95 wt. %, about 10 to about 90 wt. %, about 15 to about 85 wt. %, about 20 to about 80 wt. %, about 25 to about 75 wt. %, about 30 to about 70 wt. %, about 35 to about 65 wt. %, about 40 to about 60 wt. %, about 40 to about 55 wt. %, about 40 to about 50 wt. %, about 40 to about 45 wt. %, and about 42 wt. %.

Additional details regarding the general preparation of sulfurized phenates can be found in, for example, U.S. Pat. Nos. 2,680,096; 3,178,368 and 3,801,507, the contents of which are incorporated herein by reference.

Considering now in detail, the reactants and reagents used in the present process, first all allotropic forms of sulfur can be used. The sulfur can be employed either as molten sulfur or as a solid (e.g., powder or particulate) or as a solid suspension in a compatible hydrocarbon liquid.

It is desirable to use calcium hydroxide as the calcium base because of its handling convenience versus, for example, calcium oxide, and also because it affords excellent results. Other calcium bases can also be used, for example, calcium alkoxides.

Suitable alkylphenols for the manufacture of the non-overbased sulfurized alkylphenate detergent which can be used in the present invention are those wherein the alkyl substituents contain a sufficient number of carbon atoms to render the resulting non-overbased sulfurized calcium alkylphenate detergent composition oil-soluble. Oil solubility may be provided by a single long chain alkyl substitute or by a combination of alkyl substituents such as 6 to 36 carbon atoms. In one embodiment, the alkylphenol used in the present invention will be a mixture of different alkylphenols, e.g., $C_{20}$ to $C_{24}$ alkylphenol. In another embodiment, the alkylphenol used in the present invention is a branched chain alkylphenol, wherein the alkyl substituent is a $C_9$ to $C_{18}$ branched alkyl group such as a $C_{12}$ alkyl derived from propylene tetramer. In one embodiment, wherein a branched chain alkylphenol derived from $C_{12}$ propylene tetramer is employed as the starting alkylphenol, the non-overbased sulfurized alkylphenate detergent will contain less than less than about 5.0 wt. %, less than about 4.0 wt. %, less than about 3.0 wt. %, less than about 2.0 wt. % of total free unsulfurized tetrapropenyl phenol starting material or its metal salt. The amount of total free unsulfurized tetrapropenyl phenol starting material or its metal salt is "total TPP" or "total residual TPP" in the non-overbased sulfurized alkylphenate detergent.

The alkylphenols can be para-alkylphenols or ortho-alkylphenols. The alkylphenol is preferably predominantly a para alkylphenol with no more than about 45 mole percent of the alkylphenol being ortho alkylphenols; and more preferably no more than about 35 mole percent of the alkylphenol is ortho alkylphenol. Alkyl-hydroxy toluenes or xylenes, and other alkyl phenols having one or more alkyl substituents in addition to at least one long chained alkyl substituent can also be used.

In general, the selection of alkylphenols can be based on the properties desired for the marine diesel engine lubricating oil compositions, notably TBN, and oil solubility. For example, in the case of alkylphenate having substantially straight chain alkyl substituents, the viscosity of the alkylphenate composition can be influenced by the position of an attachment on alkyl chain to the phenyl ring, e.g., end attachment versus middle attachment. Additional information regarding this and the selection and preparation of suitable alkylphenols can be found, for example, in U.S. Pat. Nos. 5,024,773, 5,320,763; 5,318,710; and 5,320,762, each of which are incorporated herein by reference.

If a supplemental sulfurization catalyst is employed, it is typically employed at from about 0.5 to about 10 wt. % relative to the alkylphenol in the reaction system or from about 1 to about 2 wt. %. In one embodiment, the sulfurization catalyst is added to the reaction mixture as a liquid. This can be accomplished by dissolving the sulfurization catalyst in molten sulfur or in the alkylphenol as a premix to the reaction.

Suitable high molecular weight alkanol which can be used in the neutralization-sulfurization are those containing 8 to 16, or 9 to 15, carbon atoms. When employed, the alkanol is typically employed at a molar charge of from about 0.5 to about 5 moles or from about 0.5 to about 4 moles or from about 1 to about 2 moles of high molecular alkanol per mole of alkylphenol. Examples of suitable alkanols include 1-octanol, 1-decanol (decyl alcohol), 2-ethyl-hexanol, and the like. It can be beneficial to use a high molecular weight alcohol in the process because it acts as a solvent and also forms an azeotrope with water and hence facilitates affords a convenient way to remove the water generated by the neutralization or any other water in the system, by azeotropic distillation either after or preferably during the reaction. The high molecular weight alcohol may also play some part in the chemical reaction mechanism in the sense that it facilitates the removal of the byproduct water during the reaction, thus pushing the reaction to the right of the reaction equation.

In one embodiment, the TBN of the lubricating oil composition is less than 30 mg KOH/g. In other embodiments, the TBN of the lubricating oil composition is from 5 to 25, from 6 to 20, from 8 to 18, 10 to 16, and 14 to 16 KOH/g.

In one embodiment the lubricating oil composition does not contain an overbased detergent comprising a salt of an alkyl-substituted hydroxybenzoic acid having at least 50 volume % of alkyl groups that are $C_{14}$ to $C_{18}$.

In the present invention, the lubricating oil composition does not contain a salt of a sulfonic acid.

In the present invention, the lubricating oil composition does not contain a conventional salicylate-based detergent.

The concentration of total free unsulfurized alkylhydroxyaromatic compound and its unsulfurized metal salts (i.e., "total TPP" or "total residual TPP") in the non-overbased sulfurized alkylphenate detergent can be determined by reverse phase High Performance Liquid Chromatography (HPLC). In the HPLC method, samples were prepared for analysis by weighing accurately 80 to 120 mg of sample into a 10 ml volumetric flask, diluting to the level mark with methylene chloride, and mixing until the sample is fully dissolved.

The HPLC system used in the HPLC method included a HPLC pump, a thermostatted HPLC column compartment, HPLC fluorescence detector, and PC-based chromatography data acquisition system. The particular system described is based on an Agilent 1200 HPLC with ChemStation software. The HPLC column was a Phenomenex Luna C8(2) 150×4.6 mm 5 μm 100 Å, P/N 00F4249E0.

The following system settings were used in performing the analyses:

Pump flow=1.0 ml/min

Maximum pressure=200 bars

Fluorescence wavelength: 225 excitation 313 emission: Gain=9

Column Thermostat temperature=25 C

Injection Size=1 μL of diluted sample

Elution type: Gradient, reverse phase

Gradient: 0-7 min 85/15 methanol/water switching to 100% methanol linear gradient.

Run time: 17 minutes

The resulting chromatogram typically contains several peaks. Peaks due to the free unsulfurized alkylhydroxyaromatic compound typically elute together at early retention times; whereas peaks due to sulfurized salts of alkylhydroxyaromatic compounds typically elute at longer retention times. For purposes of quantitation, the area of the single largest peak of the free unsulfurized alkylhydroxyaromatic compound and its unsulfurized metal salt was measured, and then that area was used to determine the concentration of the total free unsulfurized alkylhydroxyaromatic compound and its unsulfurized metal salt species. The assumption is that the speciation of alkylhydroxyaromatic compounds does not change; if something does change the speciation of the alkylhydroxyaromatic compounds, then recalibration is necessary.

The area of the chosen peak is compared to a calibration curve to arrive at the wt. % of free alkylphenol and free unsulfurized salts of alkylphenols. The calibration curve was developed using the same peak in the chromatogram obtained for the free unsulfurized alkylhydroxyaromatic compound used to make the phenate detergent.

The Oil of Lubricating Viscosity

The base oil of lubricating viscosity for use in the lubricating oil compositions of this invention is typically present in a major amount, e.g., an amount of greater than 40 wt. %, an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered base oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any major amount of Group I base oil and may be employed in a mixture with other basestocks such as a Group II lubricating base oil. In one embodiment, the base oil is a Group I base oil, or a blend of two or more different Group I base oils. In another embodiment, the base oil is a mixture of a major amount of Group I in combination with Group II base oils.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in API categories I and II, as defined in API Publication 1509, 14th Edition, Addendum I, December 1998. A major amount of Group I base oil is preferred for use in this invention.

The saturates levels, sulfur levels and viscosity indices for Group I and II base oils are listed in Table 1 below.

TABLE 1

| Group | Saturates (As determined by ASTM D 2007) | Sulfur (As determined by ASTM D 2270) | Viscosity Index (As determined by ASTM D 4294, ASTM D 4297 or ASTM D 3120) |
|---|---|---|---|
| I | Less than 90% saturates. | Greater than or equal to 0.03% sulfur. | Greater than or equal to 80 and less than 120. |
| II | Greater than or equal to 90% saturates. | Less than or equal to 0.03% sulfur. | Greater than or equal to 80 and less than 120. |

Suitable Group I base oils include, for example, any light overhead cuts and heavier side cuts from a vacuum distillation column, such as, for example, any Light Neutral, Medium Neutral, and Heavy Neutral base stocks. The petroleum derived base oil also may include residual stocks or bottoms fractions, such as, for example, bright stock. Bright stock is a high viscosity base oil which has been conventionally produced from residual stocks or bottoms and has been highly refined and dewaxed. Bright stock can have a kinematic viscosity greater than about 180 cSt at 40° C., or even greater than about 250 cSt at 40° C., or even ranging from about 500 to about 1100 cSt at 40° C.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Additional Lubricating Oil Additives

The lubricating oil compositions prepared by the process of the present invention may also contain other conventional additives for imparting auxiliary functions to give a finished lubricating oil composition in which these additives are dispersed or dissolved. For example, the lubricating oil compositions can be blended with antioxidants, anti-wear agents, ashless dispersants, detergents, rust inhibitors, dehazing agents, demulsifying agents, metal deactivating agents, friction modifiers, antifoaming agents, pour point depressants, co-solvents, package compatibilisers, corrosion-inhibitors, dyes, extreme pressure agents and the like and mixtures thereof. A variety of the additives are known and commercially available. These additives, or their analogous compounds, may be employed for the preparation of the lubricating oil compositions of the invention by the usual blending procedures.

Examples of antiwear agents include, but are not limited to, zinc dialkyldithiophosphates and zinc diaryldithiophosphates, e.g., those described in an article by Born et al. entitled "Relationship between Chemical Structure and Effectiveness of some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Representative examples of ashless dispersants include, but are not limited to, amines, alcohols, amides, or ester polar moieties attached to a polymer backbone via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, esters, and salts.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by formula I:

Formula I

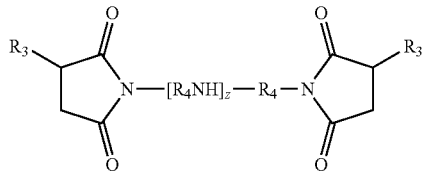

wherein each $R_3$ is independently a hydrocarbyl group, such as a polyolefin-derived group. Typically the hydrocarbyl group is an alkenyl group, such as a polyisobutenyl group. Alternatively expressed, the $R_3$ groups can contain about 40 to about 500 carbon atoms, and these atoms may be present in aliphatic forms. $R_4$ is an alkylene group, commonly an ethylene ($C_2H_4$) group; and z is 1 to 11. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the nitrogen functionality may be in the form of amines, amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629. 3,591,598 and 3,980,569.

In one embodiment, the ashless dispersant is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

Generally, the one or more ashless dispersants are present in the lubricating oil composition in an amount ranging from about 0.01 wt. % to about 10 wt. %, based on the total weight of the lubricating oil composition.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are herein incorporated by reference; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 5 wt. %.

Examples of antioxidants include, but are not limited to, aminic types, such as diphenylamine, phenyl-alpha-napthylamine, N,N-di(alkylphenyl) amines, alkylated phenylenediamines, alkylated diphenylamines, and mixtures thereof. Examples of phenolic type antioxidants include, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

Generally, the concentration of each of these additives, when used, may range, unless otherwise specified, from about 0.001% to about 20% by weight, and in one embodiment about 0.01% to about 10% by weight based on the total weight of the lubricating oil composition.

The final application of the lubricating oil compositions containing the molybdated succinimide complexes prepared by the process of this invention may be, for example, in marine cylinder lubricants in crosshead diesel engines, crankcase lubricants in automobiles and railroads and the like, lubricants for heavy machinery such as steel mills and the like, or as greases for bearings and the like. Whether the lubricating oil composition is fluid or solid will ordinarily depend on whether a thickening agent is present. Typical thickening agents include polyurea acetates, lithium stearate and the like.

In another embodiment of the invention, the composition prepared by the process of the present invention may be provided as an additive package or concentrate in which the additive is incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will also typically contain one or more of the various other additives, referred to above, in the desired amounts and ratios to facilitate direct combination with the requisite amount of base oil.

EXAMPLES

The following non-limiting examples are illustrative of the present invention.

Examples 1-3, and Comparative Examples 1-3

Table 2 below lists Examples 1-3, and Comparative Examples 1-3. The finished trunk piston engine lubricating oil compositions were prepared by mixing together a major amount of a Group I basestock, the appropriate detergent composition, 0.67 wt.-% of a secondary zinc dialkyldithiophosphate, 1.0 wt.-% of a non-post treated bis-succinimide dispersant, and a foam inhibitor. Each example had a TBN of about 15 mgKOH/g and was formulated to SAE 40 viscosity grade.

TABLE 2

SAE 40, Trunk Piston Engine Lubricating Oil Compositions

| | Ex. 1 | Ex. 2 | Ex. 3 | Comp. 1 | Comp 2 | Comp 3 |
|---|---|---|---|---|---|---|
| Detergent A (150 BN carboxylate), wt. % | 3.33 | 3.33 | 3.33 | — | 3.33 | — |
| Detergent B (350 BN carboxylate), wt. % | 2.29 | 2.53 | 2.69 | — | 1.70 | — |
| Detergent C (170 BN salicylate), wt. % | — | — | — | 2.94 | — | — |
| Detergent D (280 BN salicylate), wt. % | — | — | — | 2.29 | — | — |
| Detergent E (425 BN sulfonate), wt. % | — | — | — | | — | 1.88 |
| Detergent F (260 BN sulfurized alkylphenate), wt. % | — | — | — | | — | 1.90 |
| Detergent G (116 BN sulfurized alkylphenate), wt. % | 1.72 | 1.00 | 0.50 | 1.72 | 3.50 | 1.72 |
| XOM Core 600N (Grp I), wt. % | 81.11 | 80.98 | 80.78 | 78.34 | 81.96 | 82.35 |
| XOM Core 2500BS (Grp I), wt. % | 9.84 | 10.45 | 10.99 | 13.00 | 7.80 | 10.44 |
| Viscosity (100° C.), $mm^2/s$ | 14.73 | 14.73 | 14.73 | 14.87 | 14.69 | 14.57 |

Detergent A: This is an oil concentrate of an overbased calcium alkylhydroxybenzoate additive, wherein at least 90 mole % of the alkyl groups are derived from $C_{20}$ to $C_{28}$ linear olefins, prepared according to the method described in Example 1 of US Patent Application 2007/0027043. This additive contained 5.35 wt. % Ca, and about 35.0 wt. % diluent oil, and had a TBN of about 150. On an actives basis, the TBN of this additive is about 230.

Detergent B: This is an oil concentrate of an overbased calcium alkylhydroxybenzoate additive, having an alkyl substituent derived from $C_{20}$ to $C_{28}$ linear olefins, prepared according to the method described in Example 1 of US Patent Application 2007/0027043. This additive contained 12.5 wt. % Ca, and about 33.0 wt. % diluent oil, and had a TBN of about 350. On an actives basis, the TBN of this additive is about 520.

Detergent C: This is a commercially available oil concentrate of a medium overbased Ca salicylate detergent additive; $CO_2$-overbased Ca primarily mono-alkylated hydroxybenzoate detergent with a nominal TBN of 170. The alkyl group is nearly quantitatively $C_{14}$-$C_{18}$. This additive contained 6.0 wt. % Ca.

Detergent D: This is a commercially available oil concentrate of a high overbased Ca salicylate detergent additive; $CO_2$-overbased Ca primarily mono-alkylated hydroxybenzoate detergent with a nominal TBN of 280. The alkyl group is nearly quantitatively $C_{14}$-$C_{18}$. This additive contained 10 wt. % Ca.

Detergent E: This additive is an oil concentrate of a high overbased alkarylcalcium sulfonate detergent. This additive concentrate contained 16 wt. % Ca, about 1.81 wt. % sulfur, about 38.7 wt. % diluent oil, and had a TBN of about 425. On an actives basis, the TBN of this additive is about 690.

Detergent F: This additive is an oil concentrate of an overbased sulfurized calcium alkylphenate detergent derived from phenol alkylated with propylene tetramer, prepared in accordance with the process in U.S. Pat. No. 4,251,379 the contents of which are incorporated herein by reference in their entirety. This additive contained 9.6 wt. % Ca, about 3.4 wt. % sulfur, about 31.4 wt. % diluent oil, and had a TBN of about 260. On an actives basis, the TBN of this additive is about 380.

Detergent G: This is an oil concentrate of a non-overbased sulfurized alkylphenate detergent which is substantially free of polyol promoter oxidation products. This additive contained 4.25 wt. % Ca, about 5.53 wt. % sulfur, about 42 wt. % diluent oil, and had a TBN of about 116. On an actives basis, the TBN of this additive is about 200.

The Group I basestocks used were ExxonMobil CORE® 600 Group I base stock and/or ExxonMobil CORE® 2500BS Group I bright stock.

Each example in Table 2 was evaluated using the following tests:

1. The Komatsu Hot Tube (KHT) test, which is a measure of high temperature detergency.
2. The Modified Institute of Petroleum 48 ("MIP-48") test, which is a measure of the degree of stability against oxidation-based viscosity increase of the lubricant.
3. The Differential Scanning calorimeter (DSC) Test, which is used to evaluate thin film oxidation stability of test oils.

Modified Institute of Petroleum 48 Test

The MIP-48 Test measures the degree of stability against oxidation-based viscosity increase of the lubricant. The test consists of a thermal and an oxidative part. During both parts of the test the test samples are heated for a period of time. In the thermal part of the test, nitrogen is passed through a heated oil sample for 24 hours and in parallel during the oxidative part of the test, air is passed through a heated oil sample for 24 hours. The samples were cooled and the viscosities of both samples were determined. The viscosity increase of the test oil caused by oxidation are determined and corrected for the thermal effect. The oxidation-based viscosity increase for each marine trunk piston engine oil composition was calculated by subtracting the kinematic viscosity at 200° C. for the nitrogen-blown sample from the kinematic viscosity at 200° C. for the air-blown sample, and dividing the subtraction product by the kinematic viscosity at 200° C. for the nitrogen blown sample.

The results MIP-48 Test are set forth in Table 3 below.

TABLE 3

| Example | viscosity increase (%) |
|---|---|
| Ex. 1 | 20.9 |
| Ex. 2 | 24.2 |
| Ex. 3 | 27.4 |
| Comp. 1 | 28.0 |
| Comp. 2 | 39.1 |
| Comp. 3 | 49.4 |

As is evident from the results in Table 3, the trunk piston engine lubricating oil compositions containing a combination of carboxylate-containing detergents and less than 3.5 wt. % of a non-overbased sulfurized alkylphenate detergent free of polyol promoter oxidation products (examples 1, 2 and 3) exhibited surprisingly better stability against oxidation-based viscosity increase (resulting in lower % viscosity increase) over the comparative examples containing either a mixture of conventional phenate and sulfonate detergents; salicylate detergents; or a combination of carboxylate-containing detergents and 3.5 wt. % of a non-overbased sulfurized alkylphenate detergent free of polyol promoter oxidation products.

Komatsu Hot Tube (KHT) Test

The Komatsu Hot Tube test is a lubrication industry bench test that measures the degree of high temperature detergency and thermal and oxidative stability of a lubricating oil. During the test, a specified amount of test oil is pumped upwards through a glass tube that is placed inside an oven set at a certain temperature. Air is introduced in the oil stream before the oil enters the glass tube, and flows upward with the oil. Evaluations of the marine trunk piston engine lubricating oils were conducted at temperatures between 300-320° C. After cooling and washing, the test result is determined by comparing the amount of lacquer deposited on the glass test tube to a rating scale ranging from 1.0 (very black) to 10.0 (perfectly clean). The result is reported in multiples of 0.5.

The results of the KHT Test are set forth in Table 4 below.

TABLE 4

| | @ 300° C., rating | @ 310° C., rating | @ 320° C., rating |
|---|---|---|---|
| Ex. 1 | 8.5 | 7.5 | 4.5 |
| Ex. 2 | 8.5 | 7.5 | 3.5 |
| Ex. 3 | 8.5 | 8.0 | 3.5 |
| Comp. 1 | 8.5 | 6.5 | 2.0 |
| Comp. 2 | 8.5 | 7.5 | 3.5 |
| Comp. 3 | 8.0 | 6.0 | 3.0 |

As is evident from the results illustrated in Table 4, the trunk piston engine lubricating oil compositions containing a carboxylate-containing detergent and a non-overbased sulfurized alkylphenate detergent free of polyol promoter oxidation products (Examples 1-3 and Comparative Example 2) exhibited surprisingly better detergency and oxidative stability properties at elevated temperatures, as is evident by their overall higher ratings, particularly at the higher temperatures of 310° C. and 320° C., over the comparative examples containing either a mixture of conventional phenate and sulfonate detergents; or salicylate detergents.

Differential Scanning Calorimeter (DSC) Test

The DSC test is used to evaluate thin film oxidation stability of test oils, in accordance with ASTM D-6186. Heat flow to and from test oil in a sample cup is compared to a reference cup during the test. The Oxidation Onset Temperature is the temperature at which the oxidation of the test oil starts. The Oxidation Induction Time is the time at which the oxidation of the test oil starts. (Higher Oxidation Induction Time means better performance). The oxidation reaction results in an exothermic reaction which is clearly shown by the heat flow. The Oxidation Induction Time is calculated to evaluate the thin film oxidation stability of the test oil.

The results of the DSC Oxidation Test are set forth in Table 5 below.

TABLE 5

| | Oxidation Induction Time (min.) |
|---|---|
| Ex. 1 | 24.91 |
| Ex. 2 | 27.70 |
| Ex. 3 | 26.91 |
| Comp. 1 | 22.56 |
| Comp. 2 | 29.70 |
| Comp. 3 | 23.23 |

As is evident from the results illustrated in Table 5, the trunk piston engine lubricating oil compositions containing a carboxylate-containing detergent and a non-overbased sulfurized alkylphenate detergent free of polyol promoter oxidation products (Examples 1-3 and Comparative Example 2) exhibited surprisingly better thin film oxidation stability of the test oil, as is evident by their overall higher oxidation induction times, over the comparative examples containing either a mixture of conventional phenate and sulfonate detergents; or salicylate detergents.

Although Comparative Example 2 demonstrated superior performance in both the KHT test and the DSC oxidation test over the comparative examples, the higher measure of oxidation-based viscosity increase in the MIP-48 test does not make the test oil of Comparative Example 2 particularly suitable as a trunk piston engine lubricant. Trunk Piston Engine Oils require a single lubricating oil to fulfill the requirements of both cylinder and crankcase lubrication and are expected to last for an extended period of time. Therefore, stability against oxidation-based viscosity increase is a critical performance requirement for Trunk Piston Engine Oils.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A marine distillate fuel trunk piston diesel engine lubricating oil composition comprising:

(a) a major amount of a Group I base oil;

(b) a detergent composition comprising:

(i) a medium overbased detergent comprising an overbased salt of a linear alkyl-substituted hydroxybenzoic acid, wherein at least 90 mole % of the alkyl groups are $C_{20}$ or greater, and wherein the TBN of the medium overbased detergent on an actives basis is from about 100 to 300 mg KOH/g;

(ii) a high overbased detergent comprising an overbased salt of a linear alkyl-substituted hydroxybenzoic acid, wherein at least 90 mole % of the alkyl groups are $C_{20}$ or greater, and wherein the TBN of the high overbased detergent on an actives basis is greater than about 300 mg KOH/g; and (iii) a non-overbased sulfurized alkylphenate detergent which is substantially free of polyol promoter oxidation products; and which is prepared by the process comprising: contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur, wherein the non-overbased sulfurized alkylphenate detergent is present at less than 3.5 wt %, wherein the ratio of weight % medium overbased detergent (i) to weight % high overbased detergent (ii) is from about 0.1:1 to 10:1; and (c) a marine distillate fuel trunk piston diesel engine lubricating oil composition additive selected from the group consisting of an antioxidant, ashless dispersant, other detergent, rust inhibitor, dehazing agent, demulsifying agent, pour point depressant, antifoaming agent, co-solvent, corrosion-inhibitor, dyes, extreme pressure agent and mixtures thereof, wherein the TBN of the composition is less than 30 mg KOH/g; and wherein the composition does not contain a friction modifier and an overbased detergent comprising a salt of an alkyl-substituted hydroxybenzoic acid having at least 50 mole % of alkyl groups that are $C_{14}$-$C_{18}$.

2. The marine distillate fuel trunk piston diesel engine lubricating oil composition of claim 1 wherein the TBN of the non-overbased sulfurized alkylphenate detergent, component (iii), is from about 180 to about 250 on an actives basis.

3. The marine distillate fuel trunk piston diesel engine lubricating oil composition of claim 1 wherein the non-overbased sulfurized alkylphenate detergent is present at from 0.1 to 3.0 wt %.

4. The marine distillate fuel trunk piston diesel engine lubricating oil composition of claim 1 further comprising less than 5.0 wt. % of total free unsulfurized tetrapropenyl phenol starting material or its metal salt in the non-overbased calcium sulfurized alkylphenate detergent.

5. The marine distillate fuel trunk piston diesel engine lubricating oil composition of claim 1 wherein the ratio of the weight % medium overbased detergent to weight % high overbased detergent is from 1.2:1 to 2.0:1.

6. The marine distillate fuel trunk piston diesel engine lubricating oil composition of claim 1 wherein the low sulfur marine distillate fuel comprises less than 0.1 wt. % sulfur.

7. The marine distillate fuel trunk piston diesel engine lubricating oil composition of claim 1 wherein the alkyl groups in components (i) and (ii) are the residue of straight chain normal alpha-olefins containing at least 90 mole % $C_{20}$ to $C_{28}$ normal alpha-olefins.

8. The marine distillate fuel trunk piston diesel engine lubricating oil composition of claim 1 wherein the TBN of the medium overbased detergent, component (i), is from about 150 to about 300 mg KOH/g on an actives basis.

9. The marine distillate fuel trunk piston diesel engine lubricating oil composition of claim 1 wherein the TBN of the high overbased detergent, component (ii), is from about 325 to about 700 mg KOH/g on an actives basis.

10. The marine distillate fuel trunk piston diesel engine lubricating oil composition of claim 1 wherein the TBN of the marine distillate fuel composition is from about 5 to about 25 mg KOH/g.

11. The marine distillate fuel trunk piston diesel engine lubricating oil composition of claim 1 wherein the composition does not contain a salicylate detergent.

12. A method for operating a trunk piston engine comprising:

(a) fueling the engine with a low sulfur marine distillate fuel, and (b) lubricating the engine with a lubricating oil composition comprising:

(1) a major amount of a Group I base oil;

(2) a detergent composition comprising:

(i) a medium overbased detergent comprising an overbased salt of a linear alkyl-substituted hydroxybenzoic acid, wherein at least 90 mole % of the alkyl groups are $C_{20}$ or greater, and wherein the TBN of the medium overbased detergent on an actives basis is from about 100 to 300 mg KOH/g;

(ii) a high overbased detergent comprising an overbased salt of a linear alkyl-substituted hydroxybenzoic acid, wherein at least 90 mole % of the alkyl groups are $C_{20}$ or greater, and wherein the TBN of the high overbased detergent on an actives basis is greater than about 300 mg KOH/g; and (iii) a non-overbased sulfurized alkylphenate detergent which is substantially free of polyol promoter oxidation products; and which is prepared by the process comprising: contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur, wherein the non-overbased sulfurized alkylphenate detergent is present at less than 3.5 wt %, wherein the ratio of weight % medium overbased detergent (i) to weight % high overbased detergent (ii) is from about 0.1:1 to 10:1; and (3) a marine distillate fuel trunk piston diesel engine lubricating oil composition additive selected from the group consisting of an antioxidant, ashless dispersant, other detergent, rust inhibitor, dehazing agent, demulsifying agent, pour point depressant, antifoaming agent, co-solvent, corrosion-inhibitor, dyes, extreme pressure agent and mixtures thereof, wherein the TBN of the composition is less than 30 mg KOH/g; and wherein the composition does not contain a friction modifier and an overbased detergent comprising a salt of an alkyl-substituted hydroxybenzoic acid having at least 50 mole % of alkyl groups that are $C_{14}$-$C_{18}$.

13. The method of claim 12 wherein the TBN of the non-overbased sulfurized alkylphenate detergent, component (iii), is from about 180 to about 250 on an actives basis.

14. The method of claim 12 wherein the wherein the non-overbased sulfurized alkylphenate detergent is present at from 0.1 to 3.0 wt %.

15. The method of claim 12 further comprising less than 5 wt. % of total free unsulfurized tetrapropenyl phenol starting material or its metal salt in the non-overbased calcium sulfurized alkylphenate detergent.

16. The method of claim 12 wherein the ratio of the weight % medium overbased detergent to weight % high overbased detergent is from 1.2:1 to 2.0:1.

17. The method of claim 12 wherein the alkyl groups in components (i) and (ii) are the residue of straight chain normal alpha-olefins containing at least 90 mole % $C_{20}$ to $C_{28}$ normal alpha-olefins.

18. The method of claim 12 wherein the TBN of the marine distillate fuel composition is from about 5 to about 25 mg KOH/g.

19. A marine distillate fuel trunk piston diesel engine lubricating oil composition comprising:

(a) a major amount of a Group I base oil; and (b) a detergent composition comprising:

(i) a medium overbased detergent comprising an overbased salt of a linear alkyl-substituted hydroxybenzoic acid, wherein at least 90 mole % of the alkyl groups are $C_{20}$ or greater, and wherein the TBN of the medium overbased detergent on an actives basis is from about 100 to 300 mg KOH/g;

(ii) a high overbased detergent comprising an overbased salt of a linear alkyl-substituted hydroxybenzoic acid, wherein at least 90 mole % of the alkyl groups are $C_{20}$ or greater, and wherein the TBN of the high overbased detergent on an actives basis is greater than about 300 mg KOH/g; and (iii) a non-overbased sulfurized alkylphenate detergent which is substantially free of polyol promoter oxidation products; and which is prepared by the process comprising: contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur, wherein the non-overbased sulfurized alkylphenate detergent is present at less than 3.5 wt %, wherein the ratio of weight % medium overbased detergent (i) to weight % high overbased detergent (ii) is from about 0.1:1 to 10:1;

wherein the TBN of the composition is less than 30 mg KOH/g; and wherein the composition does not contain a friction modifier and an overbased detergent comprising a salt of an alkyl-substituted hydroxybenzoic acid having at least 50 mole % of alkyl groups that are $C_{14}$-$C_{18}$.

20. A method for operating a trunk piston engine comprising:

(a) fueling the engine with a low sulfur marine distillate fuel, and (b) lubricating the engine with the marine distillate fuel trunk piston diesel engine lubricating oil composition of claim 19.

* * * * *